US006218987B1

(12) United States Patent
Derneryd et al.

(10) Patent No.: US 6,218,987 B1
(45) Date of Patent: Apr. 17, 2001

(54) RADIO ANTENNA SYSTEM

(75) Inventors: Sven Anders Gösta Derneryd, Hisings Backa; Sven Oscar Petersson, Sävedalen, both of (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/073,267

(22) Filed: May 6, 1998

(30) Foreign Application Priority Data

May 7, 1997 (SE) ..... 9701722

(51) Int. Cl.[7] ..... H01Q 3/26
(52) U.S. Cl. ..... 342/373
(58) Field of Search ..... 342/373, 368

(56) References Cited

U.S. PATENT DOCUMENTS

| | | | | |
|---|---|---|---|---|
| 3,868,695 | | 2/1975 | Kadak | 343/778 |
| 4,231,040 | | 10/1980 | Walker | 343/100 |
| 4,316,192 | | 2/1982 | Acoraci | 343/100 |
| 4,359,741 | | 11/1982 | Cassel | 343/754 |
| 4,641,144 | * | 2/1987 | Prickett | 343/754 |
| 4,652,879 | | 3/1987 | Rudish et al. | 342/371 |
| 5,280,292 | * | 1/1994 | Tondryk | 342/373 |
| 5,479,177 | | 12/1995 | Rudish et al. | 342/375 |
| 5,596,333 | | 1/1997 | Bruckert | 342/457 |
| 5,689,272 | * | 11/1997 | Harrison et al. | 342/373 |
| 5,854,611 | * | 12/1998 | Gans et al. | 342/373 |

FOREIGN PATENT DOCUMENTS

| | | |
|---|---|---|
| 0 468 662 | 1/1992 | (EP) . |
| 2 169 453 | 7/1986 | (GB) . |
| 96/30964 | 10/1996 | (WO) . |
| 97/23017 | 6/1997 | (WO) . |

OTHER PUBLICATIONS

J. L. Allen, "A Theoretical Limitation on the Formation of Lossles Multiple Beams in Linear Arrays", IRE Transactions on Antennas and Propagation, vol. AP–9 pp. 350–352 (Jul. 1961).*

* cited by examiner

*Primary Examiner*—Gregory C. Issing
(74) *Attorney, Agent, or Firm*—Burns, Doane, Swecker & Mathis, L.L.P.

(57) ABSTRACT

The invention relates to an apparatus and a method for simultaneously generating, with the same radio antenna apparatus (10), a number of narrow beams and a wide beam, covering substantially the same area covered by the individual pointed beams together. The radio antenna apparatus (10) comprises an antenna array (3) a Butler matrix (2) connected to the antenna array and a set of amplifying modules (1*a*, . . . 1*h*). The activation of each of the inputs (L1, . . . , L8) of the radio antenna apparatus corresponds to a radiation pattern characterized by a narrow beam with a high antenna gain from the antenna array (3). By simultaneously activating the beam ports with the same signal with suitable phase relationships a superimposition of the radiation patterns to which the activated beam port corresponds is achieved in such a way that a wide beam is generated. Since all amplifying modules (1*a*, . . . , 1*h*) are used simultaneously, the lower antenna gain of the wide beam will be compensated by a corresponding higher amplification. The wide beam will therefore have substantially the same range as the narrow beams.

17 Claims, 5 Drawing Sheets

RADIO ANTENNA SYSTEM

TECHNICAL FIELD

The present invention relates to an apparatus and a method for generating radiation patterns for an antenna array.

BACKGROUND OF THE INVENTION AND STATE OF THE ART

In mobile telephony systems, apart from traffic channels on which speech and other types of data are transmitted between a base station and a mobile station, so called control channels transferring different types of control information are also used. Some of these control channels, like the traffic channels, transfer point-to-point information between the base station and the mobile stations. Other control channels are used by the base station for communication with all mobile stations within a sector cell at the same time. This requires an antenna at the base station having a sufficiently wide beam in the horizontal plane to cover the whole sector in question. Such a sector covering beam usually has a limited beam width in the vertical dimension and thus forms a horizontal disk, a so called flat beam.

The range requirement for channels for point-to-point information is the same as for channels for point-to-multipoint information. In present systems therefore one and the same sector antenna is used for both these functions. Point-to-point information, however, would not have to be transmitted from the base station in such a way that all mobile stations in the sector can receive it. It is enough that the mobile station for which the information is intended can. The base station, therefore, might concentrate the transmit power, even sideways, to the desired directions by using antennas having radiation patterns with narrow beams. If the same antennas are used for reception as well, a corresponding increase in the receiver sensitivity in the desired directions is achieved. This concentration of the transmit power and the receiver sensitivity can be used to increase the range and/or lower the power demands on the transmitters of both the base station and the mobile station. Since the channel frequency reuse spacing may be reduced with this method, the total capacity of the mobile telephony system may also be improved in this way.

One perceivable possibility of creating several simultaneous narrow beams is using a Butler matrix connected to an antenna array. A Butler matrix is a completely passive and reciprocal circuit comprising an interconnection of a number of hybrid couplers and either fixed phase shifting elements or transmission cables of varying lengths. A Butler matrix for an antenna of N elements, N being an integer number, usually a power of two, has N input ports and N output ports and therefore enables the generation of N narrow beams. A signal on one of the input ports to the Butler matrix results in signals on the output ports of the matrix of substantially the same amplitude but different phases. Each input port corresponds to a certain combination of phases on the output ports. Each one of these combinations generates a narrow beam from the antenna array. Since the antenna and the Butler matrix are completely reciprocal the system works as well for reception as for transmission.

Using an antenna fed from a Butler matrix, a set of narrow beams may be achieved, in which each individual radiation pattern has nulls for each angle at which another radiation pattern shows a maximum power (if the power is normalized using the antenna gain of the element pattern). Narrow beams meeting this criterion are said to be mutually orthogonal. Using a Butler matrix in combination with an antenna array to achieve a set of narrow beams is previously known per se.

It would be possible to use a separate sector antenna or alternatively one of the columns in an antenna array for the wide beam function. The lower antenna gain for the wide beam function would then have to be compensated with a higher amplifying power. The antenna gain here denotes the relationship between the maximum radiation of an antenna and the radiation of an ideal omnidirectional antenna with no loss, with the same supplied power. For example, an antenna array with eighth columns has an antenna gain that is 9 dB higher than a single antenna column or a sector antenna. This implies that the power amplification of the amplifier must be 9 dB higher to compensate for the lower antenna gain.

UK patent specification GB 2 169 453 discloses a method of generating a number of narrow beams with different directions and one wide beam covering the same area as all the narrow beams together using an antenna array. Here an electromagnetic lens of a so called Rotman type with parallel plates is used. On one side of the lens there are a number of beam ports and on the opposite side there are a number of antenna ports. Each one of these antenna ports is coupled, through an amplifying module, to an antenna element in an antenna array. Each beam port corresponds to one of the narrow beams in the prior art. Further, the lens is equipped with a separate connection, the position of which on the lens is adjusted so that the geometrical distances to the antenna ports cause the supplied signal power to this connection to be divided over the antenna ports in such a way that a wide beam is generated from the antenna array.

The electromagnetic lens is a spacious and expensive component that is not available on the market. Also, the wide beam, as in the previously described cases, obtains a lower antenna gain than the narrow beams, which requires expensive additional, separate amplification for the wide beam not to give a shorter range than that of the narrow beams.

SUMMARY OF THE INVENTION

It is, as mentioned above, desirable to enable the implementation of an apparatus and a method for the simultaneous generation, with one antenna apparatus, of a number of narrow beams and a wide beam, substantially covering the same area as is covered by the individual narrow beams together, thus achieving a sufficient range for the desired wide beam function. The range of the wide beam must be substantially the same as that of the narrow beams. The narrow beams have a higher antenna gain compared to the wide beam function. Meeting these requirements have been a problem in the past.

The present invention solves this problem by utilizing an antenna array comprising a first number of sub-arrays each comprising at least one antenna element, and beam forming apparatus connected to the antenna array, such as a Butler matrix comprising a second number of antenna ports and a third number of beam ports, the activation of each of at least a number of said beam ports separately corresponds to a radiation pattern characterized by a narrow main beam from the antenna array. By the simultaneous activation of at least a number of said beam ports by the same signal with suitable phase shifts a superimposition of the radiation patterns corresponding to the respective activated beam port is achieved in such a way that a wide beam is generated.

In the beam forming apparatus said antenna ports and beam ports are mutually connected in such a way that an individual activation of the beam ports, through an amplifying module for each port, causes a signal distribution on the antenna ports, specific for each beam port and corresponding to a specific radiation pattern with a narrow main beam from the antenna array. To the beam ports of the beam forming apparatus amplifying modules are connected. By distributing a wide beam signal, preferably with an even power distribution and supplying it to the beam ports through the amplifying modules the antenna array is caused to generate said wide beam. The wide beam signal is then transmitted from the antenna array over a relatively large angular interval. With suitable phase relationships on the wide beam signal at the beam ports the beam forming apparatus is thus brought to concentrate the signal power mainly to one of said antenna ports. Thereby the signal will mainly be transmitted by one of said sub-arrays, each of which comprises at least one antenna element. The beam width of the wide beam will thus be determined mainly by the individual radiation pattern of the sub-arrays. By using all the amplifying modules simultaneously when generating the wide beam the lower antenna gain of the wide beam will be compensated by a corresponding higher amplification, giving the wide beam the desired range.

The wide beam function is achieved by a suitable choice of phase relationships between the beam signals. In a preferred embodiment of the invention practically all the power is concentrated to one of said antenna ports and thus also to one of the sub-arrays in the antenna array. The radiation pattern thus has a wide and smooth main beam.

An object of the present invention is to achieve an apparatus and a method for, using the same radio antenna apparatus, simultaneously being able to generate a number of narrow beams and a wide beam substantially covering the same area as is covered by the individual narrow beams together.

Another object of the invention is to achieve an apparatus and method for mobile telephony systems for enabling the communication between base stations and mobile stations over narrow beams.

An advantage of the present invention is that all the amplifying modules may be used simultaneously in the generation of the wide beam to obtain a sufficient range.

Another advantage of the present invention is that an apparatus for generating, simultaneously and with only one radio antenna apparatus, a number of narrow beams and a wide beam is achieved, which meets high demands on cost and space.

A further advantage of the present invention is that it enables the utilization of narrow beams in mobile telephony systems, through which reduced interference and improved use of frequencies may be achieved.

The invention will be described in more detail in the following by means of embodiments and with reference to the appended drawings.

DETAILED DESCRIPTION OF PREFERRED EMBODIMENTS

Figure 1:
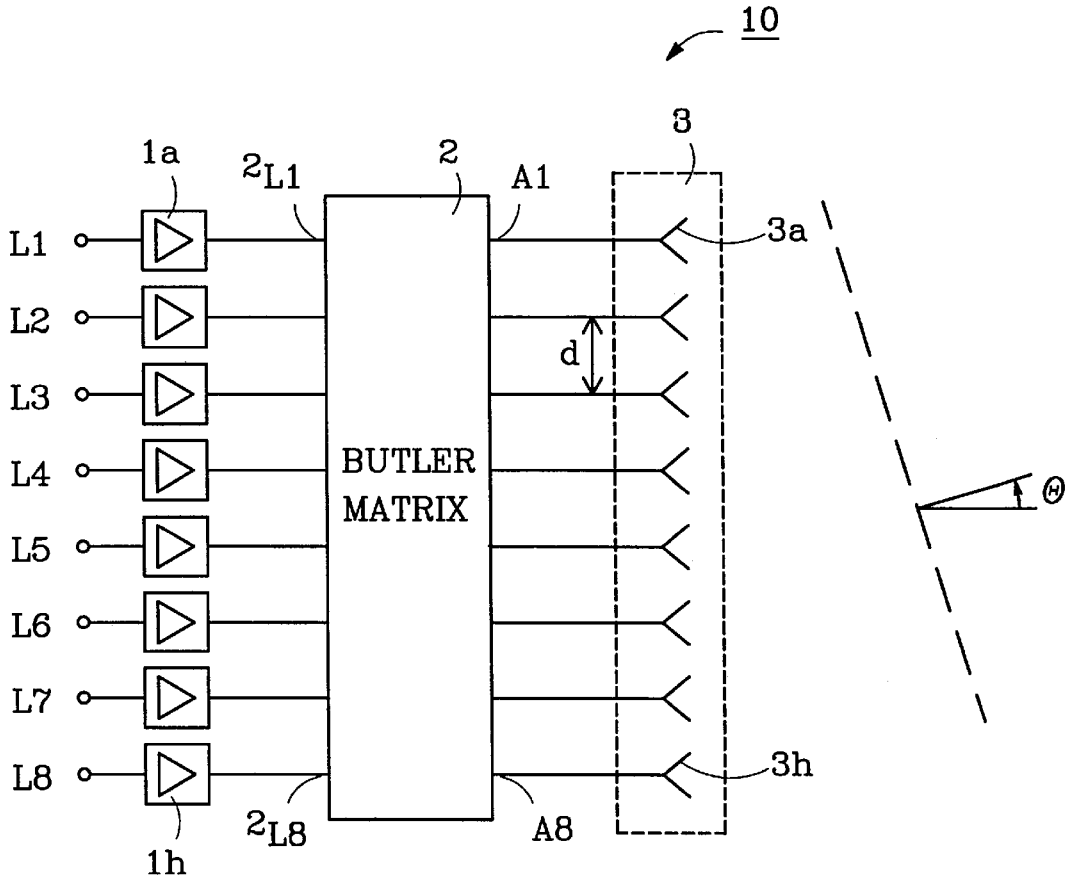
FIG. 1 is a block diagram illustrating a preferred embodiment of the invention.

FIG. 1 illustrates a radio antenna apparatus 10 comprising an antenna array 3 comprising eight antenna elements 3*a*, . . . , 3*h*, a Butler matrix 2 and eight amplifying modules 1*a*, . . . , 1*h*. The Butler matrix 2 in turn comprises eight antenna ports A1, . . . , A8, each connected to an antenna element 3*a*, . . . , 3*h*, and eight beam ports $\mathbf{2}_{L1}, \ldots, \mathbf{2}_{L8}$. Each of said eight amplifying modules 1*a*, . . . , 1*h* comprises a first connection L1, . . . , L8 and a second connection, said second connections being connected to said eight beam ports $\mathbf{2}_{L1}, \ldots, \mathbf{2}_{L8}$.

Figure 2:
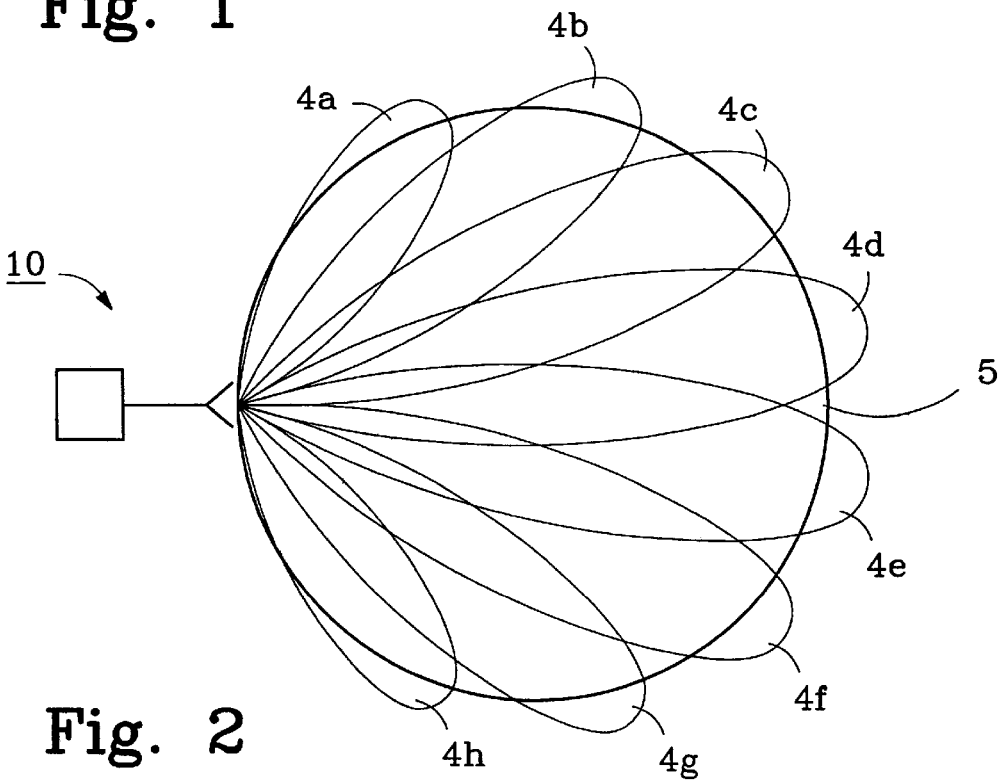
FIG. 2 shows a view of radiation patterns obtained by the embodiment shown in FIG. 1.

FIG. 2 illustrates the main radiation pattern of this radio antenna apparatus 10. The radio antenna apparatus is arranged to generate eight narrow, partially overlapping narrow beams 4*a*, . . . 4*h*. Individual activation of the beam ports generates a signal distribution, specific to each beam port, on the antenna ports, corresponding to a narrow beam from the antenna array in a specific direction. Further, the radio antenna apparatus is to be able to generate a wide beam 5, covering substantially the same area as the eight narrow beams 4*a*, . . . , 4*h* together.

According to a preferred embodiment of the invention the narrow beams 4*a*, . . . , 4*h* will be mutually orthogonal. Hereby each individual narrow beam's radiation pattern has nulls for each angle in which another radiation pattern has a maximal power (if the power is normalized using the antenna gain of the element pattern).

Figure 3:
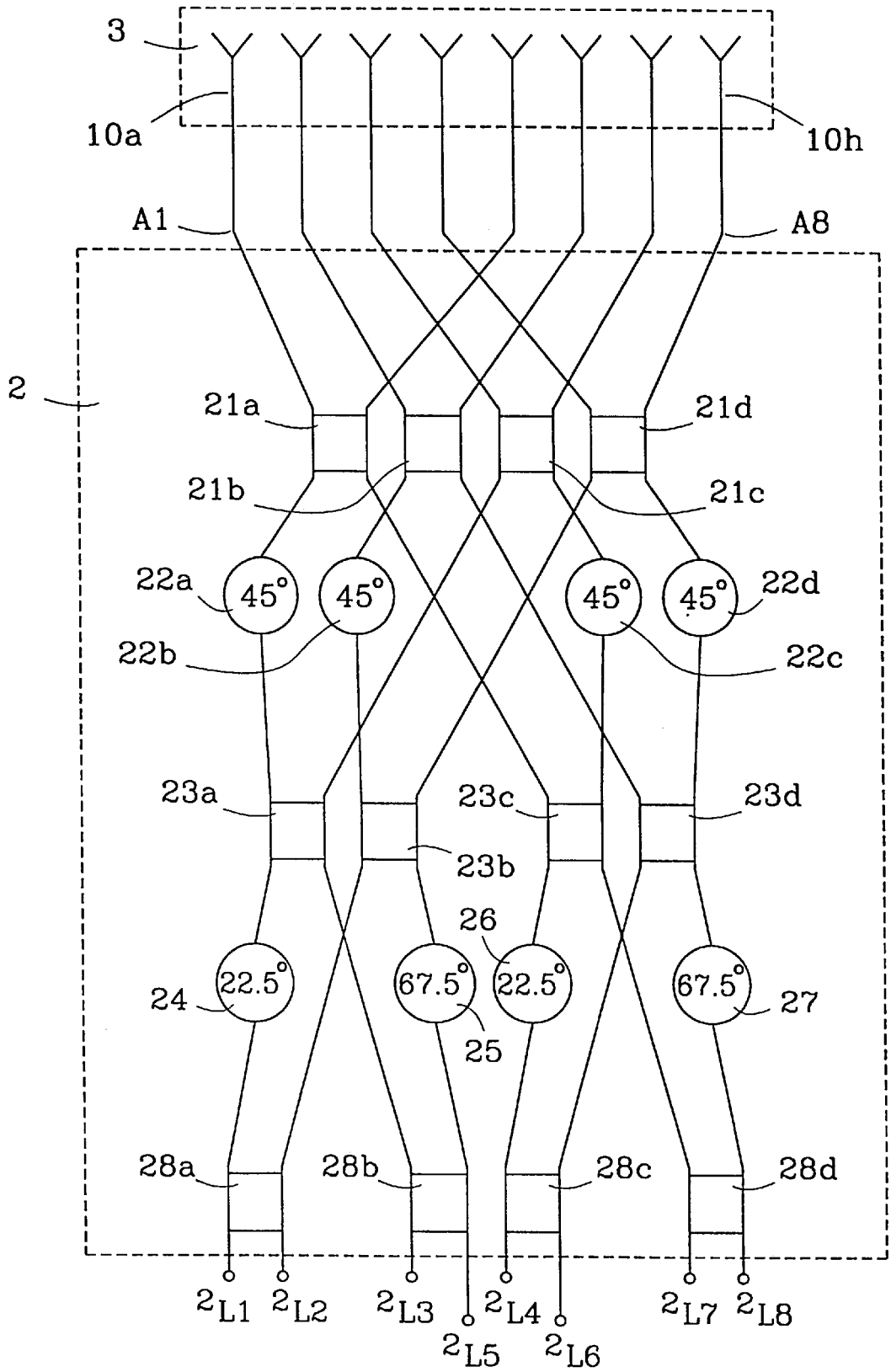
FIG. 3 is a connection diagram showing a Butler matrix, according to prior art, for the embodiment shown in FIGS. 1 and 2.

The Butler matrix 2 is shown in more detail in FIG. 3. Between the beam ports $\mathbf{2}_{L1}, \ldots, \mathbf{2}_{L8}$ and the antenna ports A1, . . . , A8 the Butler matrix 2 comprises, as is known in the art, a first set of hybrid couplers 21*a*, . . . , 21*d*, a second set of hybrid couplers 23*a*, . . . , 23*d* and a third set of hybrid couplers 28*a*, . . . 28*d* in such a way that each beam port $\mathbf{2}_{L1}, \ldots, \mathbf{2}_{L8}$ is connected to each antenna port A1, . . . , A8. Supplied signal power on one of the beam ports will be distributed substantially evenly over the antenna ports. Further the Butler matrix comprises a number of fixed phase shifting elements 22*a*, . . . , 22*d*, 24, 25, 26, 27. The bandwidth of the Butler matrix depends on the implementation of the hybrid couplers and the phase shifting elements. There are examples of Butler matrices having a bandwidth of up to an octave.

The definition of a Butler matrix dictates a defined relationship between the beam ports and the antenna ports of the matrix. A number of ways to implement a Butler matrix are, however, disclosed in the literature. The present invention is also not limited to Butler matrices. Other types of matrices, for example a so called Blass matrix or an electromagnetic lens of, for example, Luneberg or Rotman type may be used as beam forming apparatuses.

To generate a wide beam with the antenna arrays 3 one of the antenna columns of the antenna array may be used. The lower antenna gain for the wide beam function would then have to be compensated for with a higher amplifier gain. For example, an antenna array of eight columns has an antenna gain 9 dB higher than a single antenna column. This implies that the amplifier must have a 9 dB higher power amplification to compensate for the lower antenna gain.

As shown in FIG. 1, the amplifying modules 1*a*, . . . , 1*h* in the present invention are arranged at the beam ports $\mathbf{2}_{L1}, \ldots, \mathbf{2}_{L8}$ of the Butler matrix on the transmitter side of the Butler matrix 2 instead of the common location in radar applications, at the antenna ports. The amplification of these amplifying modules is dimensioned so that the range requirement is met with one amplifying module and the antenna gain for one narrow beam. This implies that each of the narrow beams meets the range requirement.

The desired wide beam, designated as 5 in FIG. 2, is generated according to the present invention in that the wide beam signal distributed over the beam ports $\mathbf{2}_{L1}, \ldots, \mathbf{2}_{L8}$ is combined at the antenna ports A1, . . . , A8 in such a way that they are added in phase in one of the antenna ports while they are added in the other antenna ports in such a phase relationship that substantially full cancellation occurs. In this way the signal will be concentrated to one of the antenna ports A1, . . . , A8. Since all the amplifying modules are used together in this way, the total power will be the sum of the contributions of all the amplifiers.

The average power for each power amplifying module is dimensioned so that each individual narrow beam will give a certain Effective Isotropic Radiated Power (EIRP). EIRP by definition corresponds to the output power multiplied by the antenna gain normalized to an ideal isotropic transmitter. When generating the wide beam function the part of EIRP originating from the antenna gain will decrease by a factor of approximately M, M corresponding to the number of antenna columns (eight in this embodiment). On the other hand the part of EIRP originating from the power amplification will increase by the same factor M, so that EIRP will be the same for the narrow beam and the wide beam.

In this example it is assumed that the distances between any two adjacent antenna columns in the antenna array 3 are equal, that is, the antenna array is a so called Uniform Linear Array (ULA) having M=8 antenna columns 3*a*, . . . , 3*h*. For a wave arriving straight on, an array response vector a(θ) is obtained according to the following:

$$a(\theta) = \begin{bmatrix} e^{j(0-(m-1)/2)2\pi d\sin\theta} \\ e^{j(1-(m-1)/2)2\pi d\sin\theta} \\ \cdots \\ e^{j(M-1-(m-1)/2)2\pi d\sin\theta} \end{bmatrix},$$

in which θ denotes the angle between the narrow beam in question and the direction that is perpendicular to the antenna array and d is the distance between two adjacent antenna columns normalized to the wavelength. This response vector a(θ) describes how the signals at the antenna ports are related to each other. The relationship between beam port signals and antenna port signals for a Butler matrix is suitable described, in a way known per se, by a transfer matrix B according to:

$$b(\theta)=B^H a(\theta),$$

in which b(θ) is a vector comprising M elements. Each element of this vector corresponds to a certain radiation function for each of the beam ports. The transfer matrix B has the dimension (M×M) and describes the relationships between the signals on the beam ports and antenna ports of the Butler matrix. H denotes a Hermitian conjugation, that is both transposition of the transfer matrix and complex conjugation of the respective matrix element.

Each column $B^{(k)}$ of the matrix B corresponds to an amplitude normalized array response vector for a value of the angle θ, specific to each column. These angles are selected in such a way that all columns are mutually orthogonal, that is:

$$B^H B=E,$$

in which E denotes the unit matrix. This gives:

$$(B^H)^{-1}=B.$$

The combined radiation function $g_{tot}(\theta)$ at excitation of several antenna ports, is obtained by superimposing the respective radiation function of the antenna columns according to $$g_{tot}(\theta)=\omega_b{}^T b(\theta),$$

in which $\omega_b$ is the excitation vector at the beam ports $\mathbf{2}_{L1}, \ldots, \mathbf{2}_{L8}$. This may also be written as $$g_{tot}(\theta)=(\omega_b{}^T B^H)a(\theta),$$

in which the excitation of the antenna columns is obtained according to $$\omega_e{}^T=\omega_b{}^T B^H,$$

$\omega_b$ being the excitation vector at the beam ports $\mathbf{2}_{L1}, \ldots, \mathbf{2}_{L8}$. If the whole signal power is concentrated to a single antenna port the combined radiation function $g_{tot}(\theta)$ of the antenna array will be determined by the characteristic of a single antenna column, thus giving a wide beam. The excitation vector $\omega_b$ at the antenna ports is therefore set to be a vector $U_k$, an arbitrary vector element of the vector $U_k$ being constituted by a constant C and all other vector elements being zero. This gives:

$$\omega_b{}^T=U_k{}^T(B^H)^{-1}=U_k{}^T B.$$

If, for example, the antenna port denoted as A2 in FIG. 1 is to be excited, the following function is obtained for the excitation vector $\omega_b$:

$$\omega_b^T = \begin{bmatrix} 0 \\ C \\ 0 \\ \vdots \\ 0 \end{bmatrix}^T \times \begin{bmatrix} B_{11} & B_{12} & \cdots & B_{18} \\ B_{21} & B_{22} & \cdots & B_{28} \\ \vdots & & & \vdots \\ B_{81} & B_{82} & \cdots & B_{88} \end{bmatrix} = C \begin{bmatrix} B_{21} \\ B_{22} \\ B_{23} \\ \vdots \\ B_{28} \end{bmatrix}^T.$$

It follows that the excitation vector $\omega_b$ at the beam ports should be one of the rows of the transfer matrix B, in this example row 2, multiplied by a constant to concentrate all the signal power to one of the antenna columns. Since all the matrix elements ideally have the same value for a Butler matrix, this means that the beam ports of the Butler matrix should be excited by the same signal strength to obtain a smooth, wide beam. The mutual phase of the beam port signals should coincide with an arbitrary row in the transfer matrix B.

According to an alternative embodiment of the invention, the phase of the wide beam signal is changed instantaneously at regular points in time at the beam ports of the Butler matrix, in such a way that the signal power from the wide beam signal is moved from one antenna column to another in the antenna array. By this procedure the power losses, and thus also the heating caused by power loss, are shared, reducing the demand and increasing the lifetime.

In this example a Butler matrix is used as a beam forming apparatus, causing the narrow beams to be orthogonal. This fact has been used when deducting the excitation vector $\omega_b$ above, when it was shown, among other things, that the signal amplitudes in the beam ports $\mathbf{2}_{L1}, \ldots, \mathbf{2}_{L8}$ should ideally be equal. Orthogonality is, however, no absolute prerequisite for the invention. If a beam forming apparatus that does not give absolute orthogonality is used, the elements of the excitation vector $\omega_b$ will, however, require different values for an even, wide beam to be obtained from the antenna array 3. The power amplifying modules 1*a*, . . . , 1*h* must therefore supply different output powers, which impairs the link budget of the radio system. According to a preferred embodiment the beam forming apparatus therefore provides orthogonal or substantially orthogonal beams.

As the antenna array 3 and the Butler matrix are entirely reciprocal elements the same antenna can also be used for reception. The receiving function is suitably enabled by means of a set of duplex filters between the amplifying modules 1*a*, . . . , 1*h* and the Butler matrix 2.

In the embodiment shown here the wide beam signal is divided on the baseband side. It is, however, possible to modulate this signal separately, divide the modulated wide beam signal and, after a suitable phase shift, feed it to said first connections L1, . . . , L8 of the eight amplifying modules 1*a*, . . . 1*h*.

Figure 4:
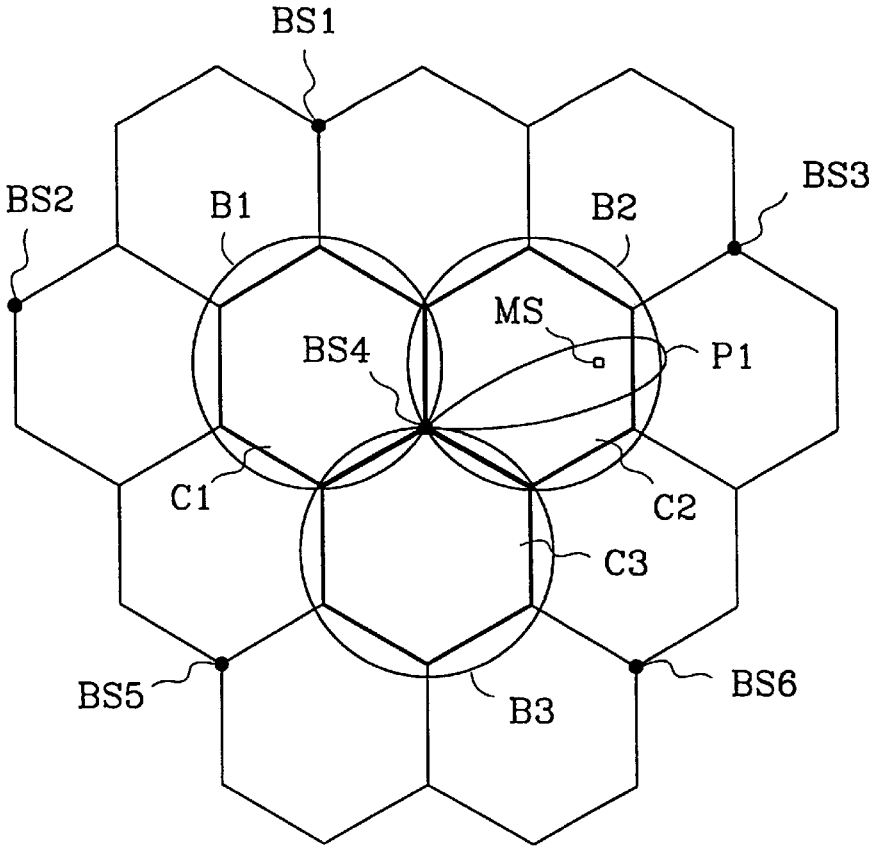
FIG. 4 shows a view of an embodiment of the invention used in a cellular mobile telephony system.

A field of application for the radio antenna apparatus 10 is shown in FIG. 4. In cellular mobile telephony systems so called sector cells are often used. In this case three base stations are placed in the same geographical location, usually referred to as a site, and have their respective antennas directed so that each antenna serves a sector cell of 120 degrees. In the figure, six such base station sites BS1, . . . , BS6 are shown. At the site BS4 a first base station serves a first cell C1, a second base station serves a second cell C2 and a third base station serves a third cell C3.

According to prior art the antennas at the base stations are characterized by wide beams covering an entire sector cell. Three wide beams B1, B2, B3 covering the first cell C1, the second cell C2 and the third cell C3, respectively, are shown in the figure. With these wide beams the respective base stations can communicate with the mobile stations that are found within the cells. Such a mobile station MS is shown in the figure. A large part of the information that is exchanged between the base stations and the mobile stations consists of point-to-point information. It would, however, not be necessary to transmit such point-to-point information in such a way that all mobile stations within the sector can receive it. It is sufficient that the mobile station for which the information is intended can receive the signal. The base stations in this embodiment of the invention use narrow beams for the point-to-point information. In this way, the output power may be concentrated to the desired directions. In the figure one such narrow beam P1 is shown. With this narrow beam the mobile station MS communicates with the base station of the cell C2 in which the mobile station is located.

The higher antenna gain caused by the narrow beam in this way improves the link budget in both directions, that is, to and from the base station. This may be utilized to increase the range relative to the output power of the base station and the mobile stations. The total capacity of the mobile telephony system may also be improved with this technology compared to the prior art, since the frequency reuse spacing may be reduced.

Some information transmitted by the base stations should, however, be received by all the mobile stations found in the cells concerned. The base stations according to the present invention are therefore able to generate wide beams. These should have substantially the same range as the narrow beams. Since each base station comprises a radio antenna apparatus, denoted as 10 in FIG. 1, each base station can generate a number of narrow beams, which together cover the cell in question. At the same time the base stations can generate a wide beam which substantially covers the whole cell.

Figure 6:
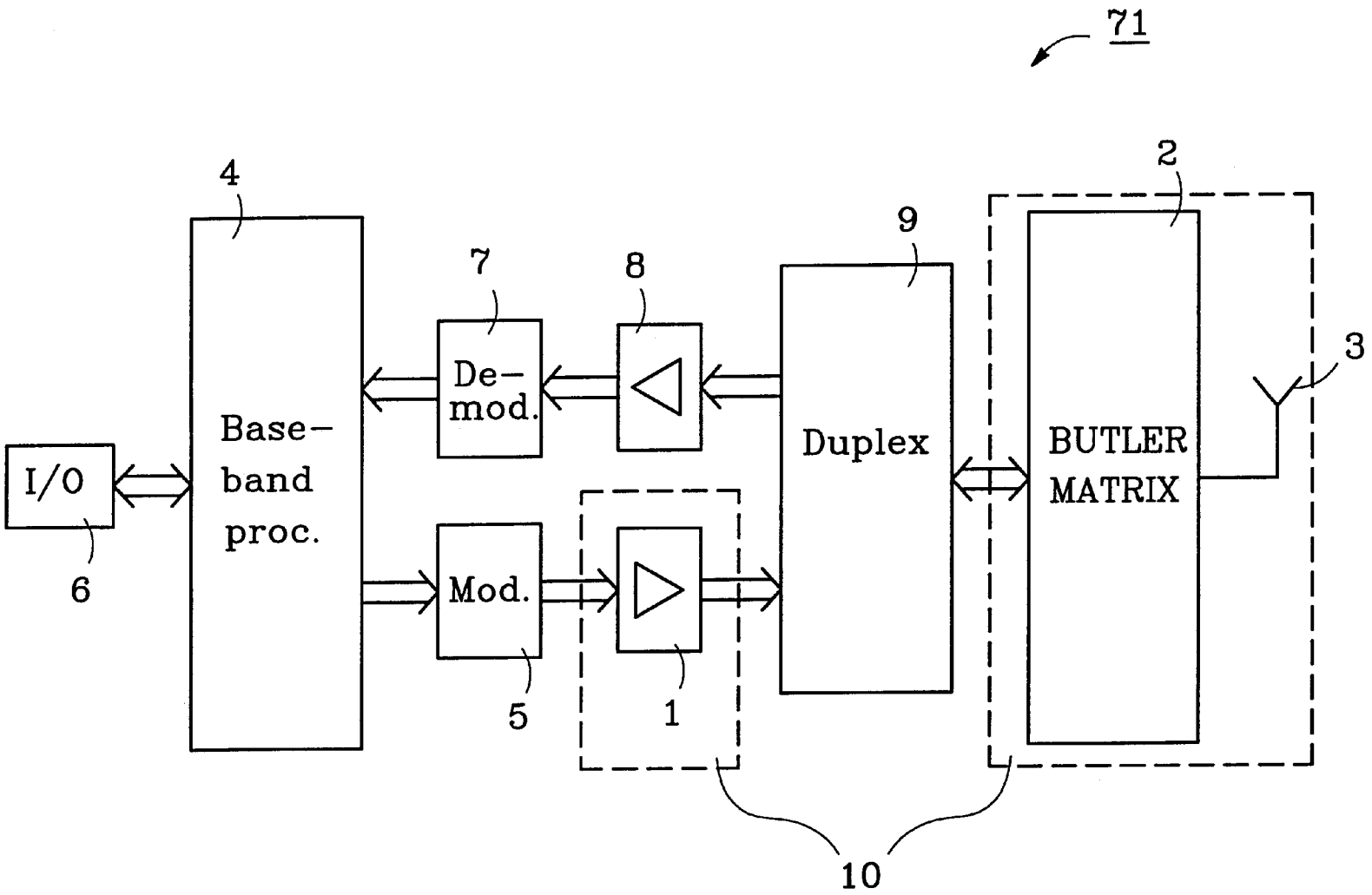
FIG. 6 is a block diagram of a base station 71 in a cellular mobile telephony network according to an embodiment of the present invention.

FIG. 6 is a simplified overview of a transceiver, in this case a base station 71 in a cellular mobile telephony network, said transceiver comprising a radio antenna apparatus according to an embodiment of the present invention. The base station 71 is an example of a communication device comprising such a radio antenna apparatus. Other types of communication devices may use such a radio antenna system in the same way.

The base station 71 comprises a baseband processing unit 4 connected to an input/output (I/O) unit 6. The base station 71 further comprises a radio antenna apparatus 10 like the one described in connection with FIG. 1. The radio antenna apparatus 10 comprises an antenna array 3 comprising eight antenna elements, a beam forming apparatus in the form of a Butler matrix 2 and an amplifying unit 1 comprising eight amplifying modules. Between the amplifying unit 1 and the Butler matrix 2 a duplex filter unit 9 is arranged, comprising a first, a second and a third set of connections. The amplifying unit 1 is connected to the first set of connections and the Butler matrix is connected to the second set of connections. To the third set of connections a second amplifying unit 8 is connected. To this second amplifying unit 8 comprising eight amplifiers, a demodulator unit 7 is connected, which in turn is connected to the baseband processing unit 4. The baseband processing unit 4 is also connected to the input terminal of a modulator unit 5. On the output terminal of the modulator unit 5 the amplifying unit 1 is connected.

The duplex filter unit 9 is arranged, in a way known in the art, to separate the receiver part of the base station, comprising said second amplifying unit 8 and demodulator unit 7, from the transmitter part of the base station comprising the first amplifying unit 1 and the modulator unit 5.

Each amplifying module in the amplifying unit 1, the output of which is connected through the duplex filter unit 9 to a single beam port of the Butler matrix 2, is connected to a single modulator in the modulator unit 5. With this arrangement the signal intended to be transmitted in a specific narrow beam is modulated separately. In a corresponding way the signal from each signal beam port in the Butler matrix 2 is demodulated separately in the demodulator unit 7. The signal demodulated in this way therefore originates from a single narrow beam.

When transmitting data to all the mobile stations in the base station's cell the amplitude of the signal is evenly distributed over all inputs of the modulator unit. Thus, all the amplifying modules in the amplifying unit 1 will be used in the amplification of this signal. When suitable phase relationships of the signals are used, the Butler matrix 2 will generate such a signal distribution over the antenna ports of the Butler matrix 2 that a wide beam will be generated from the antenna array 3.

The radio antenna apparatus described above is particularly well suited for mobile telephony systems using Single Carrier Power Amplifier (SCPA) technology (that is, carrier specific amplifiers used in the base stations) when several different carriers are used at the same time. This requires that the signal to be transmitted is amplified before different carrier waves are mixed. This requirement is met according to the present invention by the amplification being made on the beam port side of the beam forming apparatus, and thus before the combination of the carriers. Further, a radio antenna apparatus according to the present invention is particularly well suited for Spatial Division Multiple Access (SDMA) in which several active radio connections are used simultaneously on the same carrier but within different beams.

Figure 5:
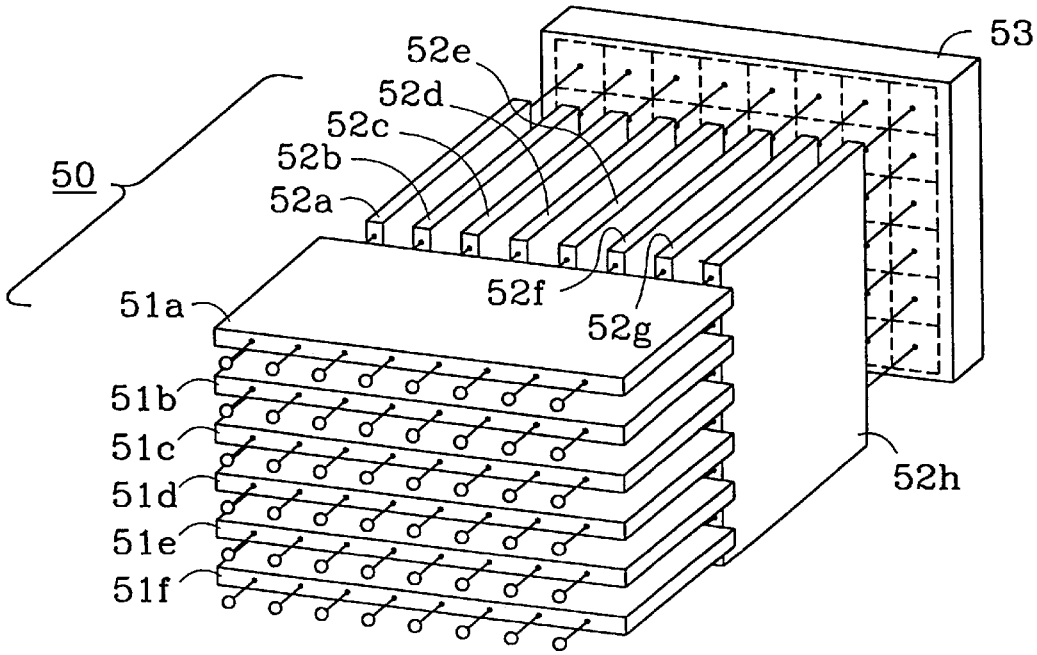
FIG. 5 is a sketch-like block diagram illustrating the principles of an embodiment of the invention with a two-dimensional Butler matrix.

In the embodiments of the invention described above a one-dimensional Butler matrix is used. The term one-dimensional here implies that the control takes place in one dimension even if each antenna column in the antenna array in a preferred embodiment of the invention comprises several antenna elements. The invention is, however, not limited to control only in one dimension. In FIG. 5 a principle sketch of a two-dimensional Butler matrix 50 is shown, by means of which the beams from an antenna array may be controlled in two dimensions. The two-dimensional Butler matrix 50 comprises a first set of one-dimensional Butler matrices 51*a*, . . . , 51*f*. The two-dimensional Butler matrix 50 further comprises a second set of one-dimensional Butler matrixes 52*a*, . . . , 52*h* cascade coupled with said first set of one-dimensional Butler matrices 51*a*, . . . , 51*f*.

Each Butler matrix 51*a*, . . . , 51*f* in said first set of Butler matrices comprises eight beam ports and eight antenna ports. In a corresponding way, each Butler matrix 52*a*, . . . , 52*h* in said second set of Butler matrices comprises six beam ports and six antenna ports. Each antenna port of the Butler matrices 52*a*, . . . , 52*h* is connected to an antenna element in a two-dimensional antenna array 53. This antenna array 53 in this example comprises 6×8=48 antenna elements.

Each of the eight antenna ports of the Butler matrix 51*a*, which are hidden in the Figure, is connected to one of the Butler matrices 52*a*, . . . , 52*h* in said second set of one-dimensional Butler matrices. In the same way, each one of the Butler matrices 51*b*, . . . , 51*f* is connected to each Butler matrix 52*a*, . . . , 52*h* in said second set of Butler matrices. In this way, each antenna port of the matrices 51*a*, . . . , 51*f* is connected to one of the beam ports of the matrices 52*a*, . . . , 52*h*.

With the first set of Butler matrices control takes place in a first dimension. With the second set of Butler matrices control takes place in a second dimension. In this way the activation of each one of the beam ports of the matrices 51*a*, . . . , 51*f* in said first set of Butler matrices corresponds to a radiation pattern from the antenna array.

A wide beam is generated according to this embodiment by the even distribution of the amplitude of a wide beam signal to the two-dimensional Butler matrix 50. This wide beam signal is power amplified by means of a set of amplifying modules not shown in the figure. With suitable phase relationships of the wide beam signal distributed over the amplifying modules, the two-dimensional Butler matrix 50 is caused to concentrate the supplied signal power to substantially one single antenna port of an arbitrary matrix of the one-dimensional Butler matrices 52*a*, . . . , 52*h*. In this way, the wide beam signal will mainly be transmitted by one of said antenna elements in the antenna array 53. The beamwidth of the wide beam obtained in this way will then mainly be determined by the individual radiation pattern of this antenna element.

The phase relationships of the wide beam signal distributed over the amplifying modules, are determined by the two-dimensional Butler matrix 50. It can be shown that 48 different phase relationships fulfil the criterion that theoretically all power is to be concentrated to an antenna port of one of the one-dimensional Butler matrices 52*a*, . . . , 52*h*. Each of these 48 phase relationships corresponds to a concentration of the signal power to one of the 48 antenna elements in the antenna array.

According to an alternative embodiment of the invention the phase relationship of the wide beam signal is instantaneously changed at regular points in time at the beam ports of the two-dimensional Butler matrix, in such a way that the signal power from the wide beam signal is moved from one antenna element to another in the antenna array. In this way the power losses, and the heating associated with power losses, are distributed over the antenna elements, reducing the demand and increasing the lifetime.

Figure 7A:
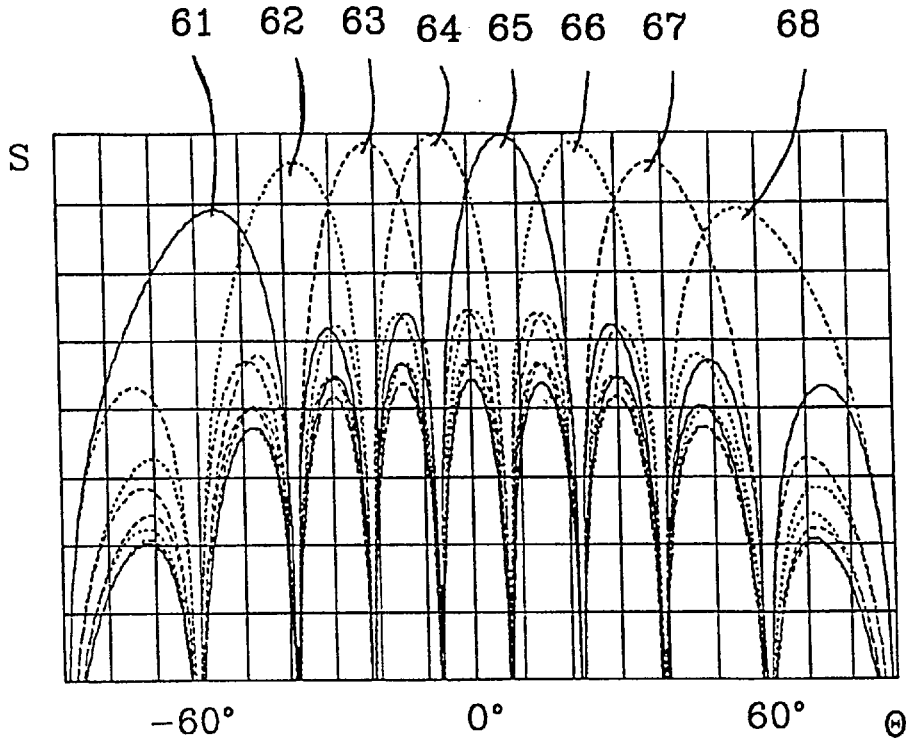
FIG. 7*a* is a signal diagram showing the radiation pattern of the embodiment shown in FIGS. 1, 2 and 3.

FIG. 7*a* is a signal diagram showing a radiation pattern for the embodiment presented above in connection with FIGS. 1, 2 and 3. In the signal diagram S denotes signal strength, measured in decibel, and θ denotes an angle relative to the direction perpendicular to the antenna array. In the signal diagram eight radiation functions are illustrated, each characterized by a narrow beam 61, . . . , 68 and a number of side lobes with a low amplitude compared to the narrow beam. The excitation of one of the beam ports of the Butler matrix, denoted $\mathbf{2}_{L1}$, . . . , $\mathbf{2}_{L8}$, in FIG. 1, corresponds to one narrow beam 61, . . . , 68 with associated sidelobes from the antenna array 3. Since the Butler matrix generates orthogonal radiation patterns, there are, as indicated in FIG. 7*a*, angles in which all eight radiation functions except one substantially has the value zero.

Figure 7B:
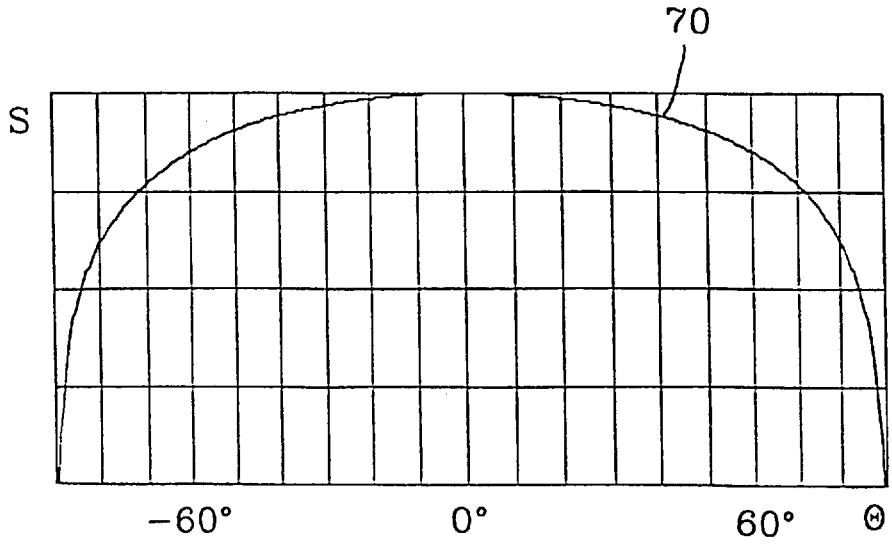
FIG. 7*b* is a signal diagram illustrating the wide beam function for the embodiment shown in FIGS. 1, 2 and 3.

FIG. 7*b* is a signal diagram illustrating the wide beam function of the embodiment presented in connection with FIGS. 1, 2 and 3. When all eight beam ports, denoted $\mathbf{2}_{L1}$, . . . , $\mathbf{2}_{L8}$ in FIG. 1 are excited with an even amplitude distribution and such phase relationships as discussed in connection with FIG. 1, a wide beam 70 is obtained which substantially covers the same angular area as the narrow beams 61, . . . , 68 in FIG. 7*a*, taken together.

What is claimed is:

1. A method of simultaneously generating a wide beam and at least one narrow beam from a radio antenna apparatus (10) comprising an antenna array (3, 53) comprising a first number of sub-arrays (3*a*, . . . , 3*h*) and at least one beam forming apparatus (2, 50) comprising a second number of antenna ports (A1, . . . , A8) and a third number of beam ports ($\mathbf{2}_{L1}$, . . . , $\mathbf{2}_{L8}$), wherein said antenna ports and beam ports are interconnected in such a way that individual activation of said beam ports causes a signal distribution over the antenna ports specific for each beam port, each resulting in a radiation pattern from the antenna array (3, 53) said radiation pattern being characterized by at least one narrow beam (4*a*, . . . , 4*h*, P1, 61, . . . , 68), said method comprising the following steps:

distributing a wide beam signal over a number of parallel connections (L1, . . . , L8) to the radio antenna apparatus (10);

amplifying the power of the divided wide beam signal;

supplying the amplified signal to at least a number of said beam ports ($\mathbf{2}_{L1}$, . . . , $\mathbf{2}_{L8}$) belonging to the beam forming apparatus (2, 50);

transmitting the antenna signals received on the antenna ports (A1, . . . , A8) by means of said antenna array (3, 53), said division of the wide beam signal having such amplitude and phase relationships that such a resulting combined radiation pattern exhibiting a wide beam (5, B1, B2, B3, 70) is obtained from the antenna array (3, 53) and further wherein the signal power, at said division of the signal power over the beam ports ($2_{L1}$, . . . , $2_{L8}$) is mainly concentrated to one of said antenna ports (A1, . . . , A8), thereby producing the wide beam with the same effective isotropic radiated power (EIRP) as the narrow beams.

2. A method according to claim 1, comprising the following steps:

redistributing said phase relationships and/or amplitude relationships so that the whole signal power originating from the wide beam signal is substantially concentrated to another one of the antenna ports (A1, . . . , A8).

3. A method according to claim 1, wherein the beam forming apparatus (2, 50) is reciprocal.

4. A method according to claim 1, wherein said antenna array (3) and said beam forming apparatus (2, 50) are also used for radio reception.

5. A method according to claim 1, wherein said sub-arrays (3*a*, . . , 3*h*) are comprised of antenna columns in the antenna array (3).

6. A method according to claim 1, wherein the narrow beams are mutually orthogonal.

7. A method according to claim 1, wherein the beam forming apparatus (2, 50) comprises at least one Butler matrix.

8. A method according to claim 1, wherein said amplitude relationships at the division of the wide beam signal over said number of parallel connections (L1, . . . , L8) to the radio antenna apparatus (10) are such that all the signal levels on the beam ports ($2_{L1}$, . . . , $2_{L8}$) resulting from said division are substantially equal.

9. A method according to claim 7, wherein said phase relationships substantially correspond to one of the rows in the transfer matrix of the Butler matrix (3, 53).

10. A radio antenna for the simultaneous generation of a wide beam and at least one narrow beam comprising:

an antenna array;

a beam-shaping device comprising a number of antenna ports connected to said antenna array and a number of beam ports, said antenna ports and beam ports being interconnected in such a way that the individual activation of said beam ports corresponds to a signal distribution on the antenna ports that is specific to each beam port to generate a radiation pattern, said radiation pattern including at least one narrow beam;

a plurality of amplifying modules, each amplifying module being connected to one of the beam ports of the beam shaping device; and means for simultaneous activation of at least a number of said beam ports to generate a wide beam by providing a superimposition of the radiation patterns to which the respective activated beam ports correspond, thereby producing the wide beam with the same effective isotropic radiated power (EIRP) as the narrow beams.

11. A radio antenna apparatus for the simultaneous generation of a wide beam and at least one narrow beam comprising:

a first antenna array (3, 53) comprising a first number of sub-arrays (3*a*, . . . , 3*h*), each sub-array comprising at least one antenna element;

at least one beam-shaping device (2, 50) comprising a second number of antenna ports (A1, . . . , A8) and a third number of beam ports ($2_{L1}$, . . . , $2_{L8}$), said antenna ports and beam ports being interconnected in such a way that the individual activation of said beam ports corresponds to a signal distribution on the antenna ports (A1, . . . , A8) that is specific to each beam port, each sub-array (3*a*, . . . , 3*h*) of said radio antenna apparatus being connected to one of the antenna ports (A1, . . . , A8) of the beam shaping device (2, 50) in such a way that each antenna port is connected to at the most one of said sub-arrays (3*a*, . . . , 3*h*), the separate activation of at least a number of said beam ports ($2_{L1}$, . . . , $2_{L8}$) corresponding to a radiation pattern each from the antenna array (3), said radiation pattern being characterized by at least one narrow beam (4*a*, . . . , 4*h*, P1, 61, . . . , 68) wherein the radio antenna apparatus comprises a fourth number of amplifying modules (1*a*, . . . , 1*h*), each amplifying module comprising a first amplifier connection and a second amplifier connection, said second amplifying connection of each amplifying module (1*a*, . . . , 1*h*) being connected to one of the beam ports ($2_{L1}$, . . . , $2_{L8}$) of the beam forming apparatus (2, 50) in such a way that each beam port is connected to at the most one of said amplifying modules (1*a*, . . . , 1*h*) and means for the simultaneous activation of at least a number of said beam ports ($2_{L1}$, . . . , $2_{L8}$) by the same signal with suitable amplitude and phase relationships providing a superimposition of the radiation patterns to which the respective activated beam port corresponds, in such a way that a wide beam (5, B1, B2, B3, 70) is generated wherein the signal power at the division of the signal power over the beam ports is mainly concentrated to one of the antenna ports, thereby producing the wide beam with the same effective isotropic radiated power (EIRP) as the narrow beams.

12. A radio antenna apparatus according to claim 11, wherein the beam forming apparatus (2, 50) is reciprocal.

13. A radio antenna apparatus according to claim 11, wherein said antenna array (3) and said beam forming apparatus (2, 50) are also arranged for radio reception.

14. A radio antenna apparatus according to claim 11, wherein the radio antenna apparatus (10) comprises a number of duplex filters (9) placed between said beam forming apparatus (2) and said amplifying module (1*a*, . . . , 1*h*).

15. A radio antenna apparatus according to claim 11, wherein in that the beam forming apparatus (2, 50) comprises at least one Butler matrix.

16. A radio antenna apparatus according to claim 11, wherein said sub-arrays (3*a*, . . . , 3*h*) are constituted by antenna columns in the antenna array (3).

17. A radio antenna apparatus according to claim 11, wherein said amplitude relationships are such that all signal levels on the beam ports ($2_{L1}$, . . . , $2_{L8}$) resulting from said division are substantially equal.

* * * * *